US007000277B2

(12) United States Patent
Torres Cervera

(10) Patent No.: US 7,000,277 B2
(45) Date of Patent: Feb. 21, 2006

(54) SPRING MATTRESS BASED ON FOAM MATERIAL

(75) Inventor: Manuel Torres Cervera, Picasent (ES)

(73) Assignee: Torres Espic, S.L., Picasent (ES)

( * ) Notice: Subject to any disclaimer, the term of this patent is extended or adjusted under 35 U.S.C. 154(b) by 0 days.

(21) Appl. No.: 10/827,874

(22) Filed: Apr. 20, 2004

(65) Prior Publication Data

US 2005/0108827 A1 May 26, 2005

(30) Foreign Application Priority Data

Nov. 25, 2003 (ES) ..... 200302759

(51) Int. Cl.
*A47C 25/00* (2006.01)

(52) U.S. Cl. ..... 5/719; 5/740

(58) Field of Classification Search ..... 5/719, 5/740, 655.9, 953; 267/143, 145
See application file for complete search history.

(56) References Cited

U.S. PATENT DOCUMENTS 2,768,924 A * 10/1956 Wright ..... 428/72
3,293,671 A * 12/1966 Griffin ..... 5/655.9
4,194,255 A * 3/1980 Poppe ..... 267/153
4,713,854 A * 12/1987 Graebe ..... 5/652
4,809,374 A * 3/1989 Saviez ..... 5/420
5,353,455 A * 10/1994 Loving et al. ..... 5/730
6,704,962 B1 * 3/2004 Choi ..... 5/740

* cited by examiner

*Primary Examiner*—Michael Trettel
(74) *Attorney, Agent, or Firm*—Michaelson & Associates; Peter L. Michaelson

(57) ABSTRACT

A spring mattress that uses a multiplicity of elastic springs, spatially distributed according to a predetermined pattern, with highly variable configurations, obtained by shaping through cutting and pouring operations on a starting slab of foam material of a proper thickness. The resulting configuration that is adopted determines incoming portions in the spring elements that affect one or more of its sides, with variable magnitudes and depths, and outcropping portions from one or more of its sides, with a thickness and projection range that are also variable. The springs that make up the mattress are integrated on their lower end to the remaining continuous laminar portion of the original slab, and in a second alternate version, can be joined on their other end to a continuous laminar slab to which they are bonded by means of adhesion or similar operation.

3 Claims, 2 Drawing Sheets

SPRING MATTRESS BASED ON FOAM MATERIAL

BACKGROUND OF THE DISCLOSURE

1. Field of the Invention

This invention refers to spring mattresses based on foam material, offering essential novel features and notable advantages as compared to the known media that are used for these same purposes with the current techniques.

In particular, the invention proposes the development of elements acting as springs, specially indicated for manufacturing mattresses that use a multiplicity of these spring elements spatially distributed, substituting the conventional metallic springs, obtained by means of cutting and pouring operations of a slab of foam material with a predetermined thickness, such as flexible polyurethane foam, to obtain the desired configuration and design for each foam spring in particular. The mattress is formed from a multiple of these springs emerging from a lower laminar portion of the starting slab. The set can then be sheathed by means of an additional operation, either directly or with the multiplicity of springs crowned at the top end with a continuous slab of the same material; also the slab can be composed of materials with different hardness, effecting the adherence with a bonding operation.

The field of application of the invention is within the industrial sector dedicated to handling of foam materials, particularly those based on flexible polyurethane.

2. Description of the Prior Art

It is a generally known fact that in the rest sector, the use of the "spring mattress" is quite common. This mattress is fashioned by a metallic wire carcass with multiple helicoidal springs inside, formed by metallic wires of an elastic nature. The evolution that this sector has undergone has led to the introduction of certain innovations to the system, among which is the system known as "encapsulated spring", in which the springs consist of helicoidally wound wires lined with a cloth forming some kind of encapsulation, with the spring inside. Other systems are also known, among which we should point out the "TwinSpring System" (double spring system). This system consists of the design and use of metallic helicoidal springs enclosed inside a high-density foam cylinder (rigid polyurethane).

However, there is no knowledge of the existence in the market of any other alternate spring system of a type similar to the one proposed in the invention, where the springs are not made of a metal part, but rather these are entirely made of foam material, thus conferring to the mattress fabricated with these springs a series of properties beneficial to the persons that use it for something as important as the need of daily rest.

SUMMARY OF THE INVENTION

Consequently, this invention has the main purpose of providing a spring mattress based on foam material, such as flexible polyurethane foam, with which we can obtain more beneficial practical results than with traditional mattresses based on metallic helicoidal springs. This purpose has been fully implemented with the construction of a mattress using the springs that will be described next, with the main features found in the features section of claim 1 that follows.

In essence, the springs that make up the type of mattress of the invention are obtained by means of cutting and pouring operations on an initial slab of foam material of a predetermined thickness that will determine the final height of the spring. These operations are performed such that successive portions of variable dimensions, with respect to the ones that the spring elastically cedes when subject to compression, are determined. The mattress is obtained using a set of these emerging springs from a lower laminar portion of the original slab with predetermined dimensions, with an additional covering operation with a sheath or similar material. Thus, in this first form of implementation, the springs form an integral part with the lower laminar portion, while with an alternative version, a second continuous laminar portion, also in the form of a slab, can be placed on the upper part of the springs to which the slab is bonded by adhesion or some other similar operation.

BRIEF DESCRIPTION OF THE DRAWINGS

These and other features and advantages of the invention will become more apparent from the detailed description that follows; it explains a preferred manner of implementation. This is given only as an example, albeit not a limiting one, with reference to the attached drawings, in which.

DETAILED DESCRIPTION OF THE PREFERRED EMBODIMENTS

The detailed description of the preferred manner of implementing the invention will now be discussed, using the attached drawings; these use the same numerical references used to designate parts that are the same or similar across two or more of the figures.

Figure 1:
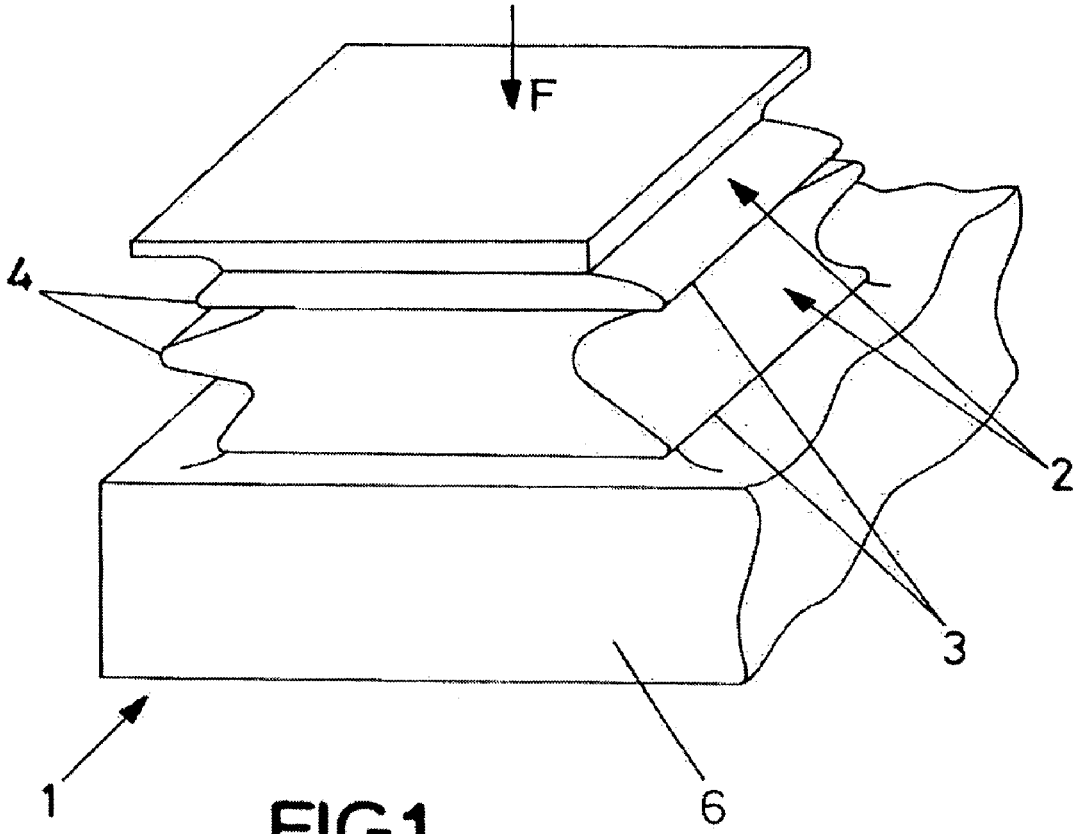
FIGS. 1 and 2 provide two three-dimensional examples of foam material springs of the type found in the mattresses of this invention, with predetermined configurations.

Consequently, referring initially to FIG. 1, one can see in this figure a three dimensional schematic representation of an example of how to implement one elastic spring element of the type proposed in the invention, shown in general by means of reference 1. As one can see, the spring element consists of a block of foam material, specifically polyurethane foam, made into a starting slab of the proper thickness, which rises with a predetermined configuration, obtained by means of cutting and pouring operations, from a remaining portion of lower slab 6 that provides support. As one can see, the arrangement referred to confers to spring element 1 areas with a smaller dimension, for example, incoming portions 2 in various positions and magnitudes, on one or more of its sides, and outcropping portions such as the ones marked with reference numbers 3, 4 on one or more of the sides of spring element 1. In this way differentiated compression and flexing effects are obtained when the spring element is subjected to pressure, as shown graphically by arrow F.

As one might understand, the application of the cutting and pouring techniques on an original slab with a predetermined thickness permits obtaining a number of such spring element 1 formations spatially distributed on the slab in correspondence with a predetermined design.

Figure 2:
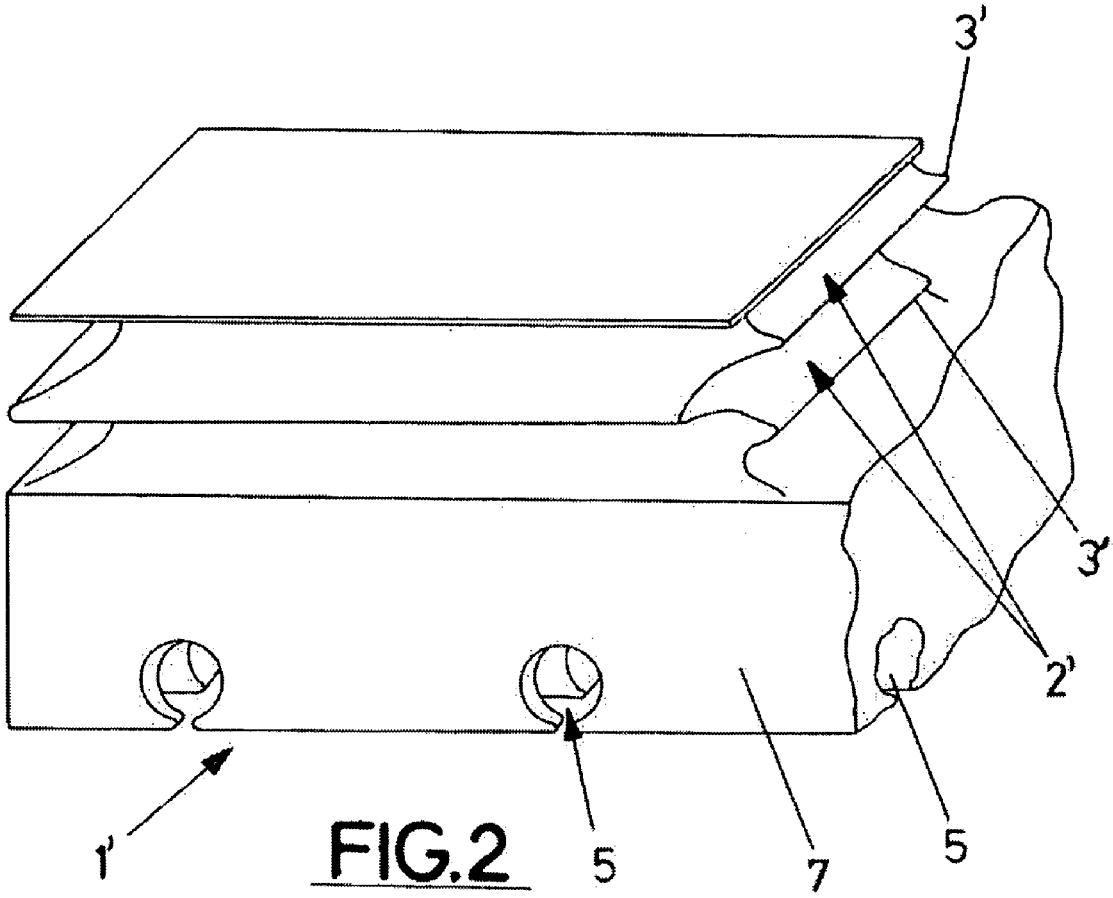

FIG. 2 shows another example of implementing a second spring element indicated in general as reference 1'. The same principles for spring element 1 were followed for the fabrication of element 1', i.e., the application of cutting and pouring operations on an original block of a proper thickness, in order to provide it with incoming portions 2' that may affect one or more of its sides, or outcropping portions 3' that may also extend from one or more of its sides with various projection magnitude and with different thickness. In this case, the spring 1' element also shows hole 5 that crosses portion 7 of the lower slab, from which spring element 1' emerges according to the longitudinal and transverse directions.

As one might understand, FIGS. 1 and 2 show only two of many ways of physically implementing the spring elements obtained by cutting and pouring on an initial slab of a proper thickness, which will be used in the construction of the mattress according to the invention. However, there are many other configurations envisioned for the invention that have not been represented in the drawings, because the construction philosophy of these configurations is always the same, i.e., application of cutting and pouring operations on an original slab with a sufficient thickness with the purpose of obtaining spatially separated spring elements by the slab, at predetermined positions, where one can distinguish incoming portions that affect one or more of its sides, with variable magnitudes and always preferably following rounded profiles, and with rising portions that project from one or more of the sides of the spring, alternating with the incoming portions, extended to a greater or lesser degree and with variable thickness. The above results in each spring element having a variable flexing behavior when subjected to a compression derived from its integration into a mattress set or similar, and an elastic recovery when the compression ceases.

Consequently, the springs may have different designs, whose behavior under compression is equivalent to the one provided by traditional springs, i.e., the proposed springs can be used directly with the application of a sheath or protective cover, or, as a second implementation, an additional slab of the same material can be applied on the upper ends, or a slab composed of materials of diverse hardness can also be applied.

Figure 3:
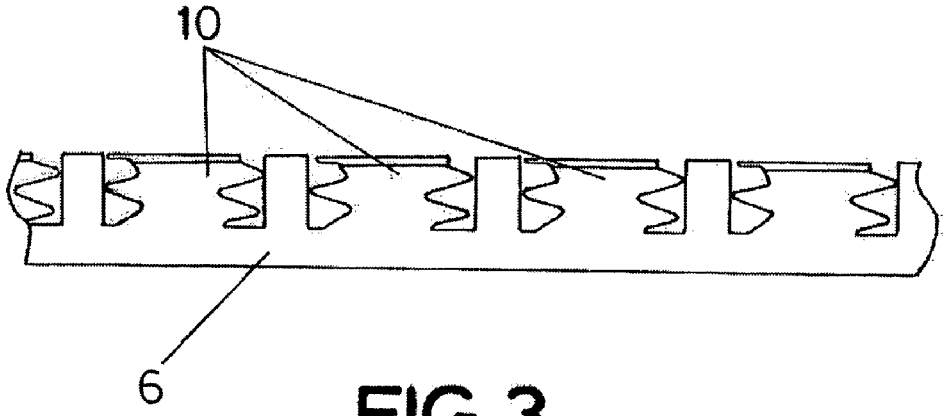
FIG. 3 shows a schematic view of the mattress based on the springs of this invention. The springs appear to rise from the lower portion of the continuous slab, from which they integrally emerge.
Figure 4:
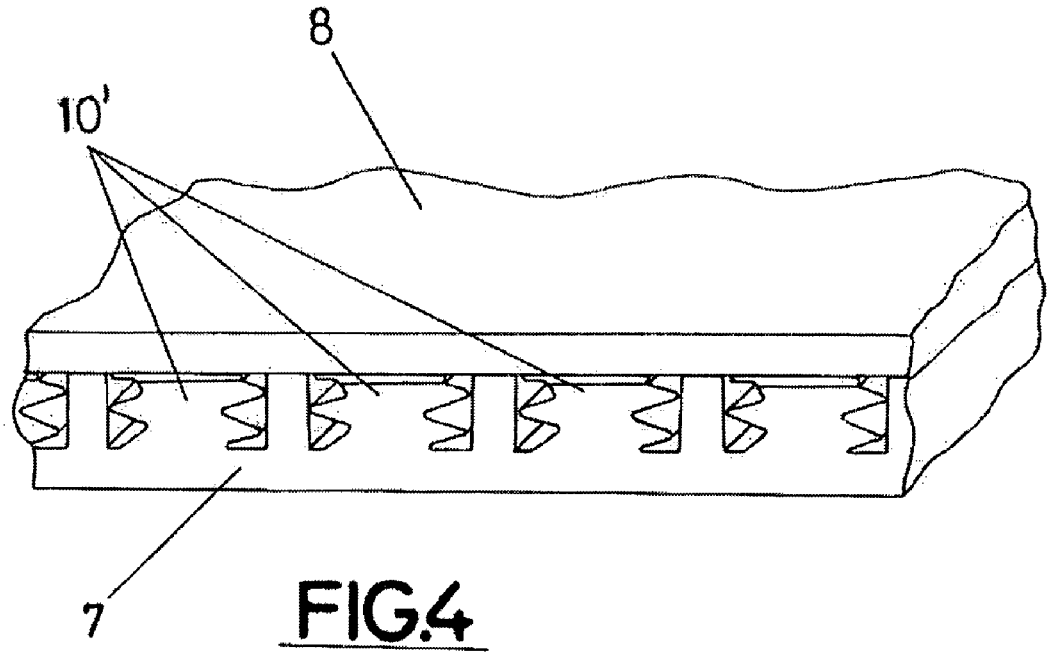
FIG. 4 is a schematic view of an alternate manner of producing the mattress based on the formation of springs according to the invention, provided also on the upper part with a second continuous foam slab.

These construction forms are represented in FIGS. 3 and 4. FIG. 3 shows an example of a mattress obtained from a multiplicity of elastic foam springs of the type being proposed in this invention, shown by means of numerical reference 10, spatially distributed according to the pattern that was used during the formation of the springs. These are integrally joined on their lower part with remaining portion 6 of the original slab on which the cutting and pouring operations were performed for the formation of these elements of spring 10. In this case, there is no additional protection with regard to the upper end of the springs 10.

However, compared to the implementation just explained above, FIG. 4 represents schematically a situation where the mattress is likewise obtained from a multiplicity of foam springs 10' that are integrated to remaining laminar portion 7 of a starting slab, spatially distributed according to a pattern that was chosen during the formation process. Upper ends of springs 10' have been provided with an additional slab 8, topping and protecting them. A union between springs 10' and slab 8 is achieved by adhesion or similar.

As one might understand, the finishing of the mattresses in FIGS. 3 and 4 may include the encapsulation of the mattresses inside sheaths, or the application of any other conventional technique that is not part of the invention.

There is no need to further extend the contents of this description inasmuch as one of ordinary skill in the art is able to understand from the description given the scope and the advantages derived from the invention, as well as to develop and bring to practical use the purpose of the invention.

Notwithstanding the above, it should be understood that the invention has been described in accordance with a preferred implementation of the invention, thus, it may be susceptible to modifications without implying any alteration of the basis of the invention. These modifications might affect the form, size and/or the use of the foam materials for fabrication.

I claim:

1. A spring mattress comprised of foam material having a plurality of spatially distributed elastic spring elements, each of said elements being formed of flexible polyurethane foam, and a sheath which encases the foam material so as to yield a finished mattress, the mattress being produced by the step of:

forming, through cutting and pouring operations, the plurality of spring elements in a starting slab of flexible polyurethane foam such that the spring elements are formed integral with and situated on a continuous lower portion of the slab, the slab having a given starting thickness defined by a desired height of the spring elements, and such that all said spring elements are spatially distributed on said lower portion with each such spring element being separated from an adjacent one of said spring elements and each of said spring elements has incoming portions, with an arched profile of differing magnitudes and varying depths, and outcropping portions, of differing thickness and variable depth;

whereby said each of said spring elements, when subjected to pressure, is able to flex and compress.

2. The mattress recited in claim 1 wherein each of the spring elements is bonded, by adhesion, on an upper portion thereof to a finishing slab, the finishing slab also being flexible polyurethane foam.

3. The mattress recited in claim 2 wherein the finishing slab is composed of materials having differing respective hardnesses.

* * * * *